US005687604A

United States Patent [19]

Robbins

[11] Patent Number: 5,687,604

[45] Date of Patent: Nov. 18, 1997

[54] THERMAL CONTROLLED MANDREL WITH REPLACEABLE TIP FOR COPPER AND BRASS EXTRUSION

[75] Inventor: Paul H. Robbins, Aurora, Canada

[73] Assignee: Exco Technologies Ltd., Markham, Canada

[21] Appl. No.: 652,685

[22] Filed: May 30, 1996

[51] Int. Cl.[6] ..... B21C 23/20

[52] U.S. Cl. ..... 72/265; 72/342.3; 72/372

[58] Field of Search ..... 72/264, 265, 268, 72/272, 342.3, 256, 372

[56] References Cited

U.S. PATENT DOCUMENTS

| | | | |
|---|---|---|---|
| 1,374,369 | 4/1921 | Earl . | |
| 3,196,659 | 7/1965 | Cairns | 72/264 |
| 3,315,515 | 4/1967 | Milnes | 72/463 |
| 3,455,137 | 7/1969 | Edgecombe | 72/264 |
| 3,580,037 | 5/1971 | Issott | 72/255 |
| 5,048,592 | 9/1991 | Mueller | 164/312 |
| 5,058,266 | 10/1991 | Knoll | 72/256 |
| 5,233,912 | 8/1993 | Mueller | 92/29 |

FOREIGN PATENT DOCUMENTS

| | | | |
|---|---|---|---|
| 2630950 | 11/1989 | France | 72/342.3 |

*Primary Examiner*—Lowell A. Larson
*Assistant Examiner*—Ed Tola
*Attorney, Agent, or Firm*—Young & Basile, PC

[57] ABSTRACT

An improved cooling system is provided in a piercing mandrel used in extruding tubular material made of metals having extruding temperatures above the annealing temperature of H13 tool steel such as brass, copper and the like. The piercing mandrel has a replaceable tip fitted on the end of the stem portion for the mandrel. A cooling channel system is provided at the distal end of the stem and comprises a disperser for dispersing cooling fluid in equi-distant, multi-radial directions as the cooling fluid flows out of the stem distal end. An annular channel is provided at the perimeter of the mating faces of the bore in the tip and the stem distal end and which is in communication with the disperser to direct radially cooling fluid annularly of the perimeter of the mating faces at the stem distal end. The cooling channel system further comprises about the perimeter of the stem distal end a plurality of equi-distant, longitudinally directed channels which are in communication with the annular channel. Cooling fluid flows from the annular channel longitudinally of the tip along the longitudinal channels. The stem distal end has a cooling fluid outlet device for collecting cooling fluid and directing spent cooling fluid outwardly along the stem.

22 Claims, 7 Drawing Sheets

THERMAL CONTROLLED MANDREL WITH REPLACEABLE TIP FOR COPPER AND BRASS EXTRUSION

FIELD OF THE INVENTION

This invention relates to tube extrusion apparatus for extruding tubes of metals having annealing temperatures above H13 tool steel such as brass, copper and the like.

BACKGROUND OF THE INVENTION

Tube extrusion is commonly achieved by the use of a piercing mandrel used in a tube extrusion apparatus. The piercing mandrel encounters significant temperatures in the extrusion process, usually in excess of 1200° F., when extruding metals such as copper and brass, ie: metals having annealing temperature above H13 tool steel. Cooling of the piercing mandrel has therefore been employed for many years to maintain the piercing mandrel at a temperature which reduces the likelihood of the piercing mandrel loosing its temper due to excessive heating. As a piercing mandrel looses its temper, ie: its hardness, the piercing mandrel tip can warp, resulting in scrap product due to varying thicknesses in the resultant tube wall. However, cooling which is commonly employed in piercing mandrels, does not appreciably extend the life of the piercing mandrel in heavy usage processes where the piercing mandrel is used several times during an extrusion shift. Temperature builds up in the mandrel tip, eventually resulting in loss of tip hardness and consequent warping. which produces unacceptable extruded tube. To avoid the problems associated with existing cooling of piercing mandrel tips, attempts have been made to make the tip of a high temperature resistant alloy such as Inconel. Piercing mandrels of such material have very acceptable extruding life expectancies. However, piercing mandrels of Inconel are very expensive and usually exceed the cost of a normal piercing mandrel of H13 tool steel by 5 to 10 times.

An exemplary form of cooling for a piercing mandrel is described in U.S. Pat. No. 3,455,137. The piercing mandrel has provided therein a tube which delivers cooling fluid along the length of the piercing mandrel in an attempt to keep the piercing mandrel at a temperature which does not result in lose of hardness, so as to maintain dimensional stability of the piercing mandrel and hence the uniform extruded tube. The thin wall design however, of the piercing mandrel of this U.S. patent does not provide sufficient structural integrity so that during an extrusion shift, the mandrel tip begins to warp, resulting in scrap product.

Replaceable tips have been provided for piercing mandrels, such as described in U.S. Pat. No. 3,580,037. Cooling is provided to the piercing mandrel tip to again achieve dimensional stability for the piercing mandrel tip. However, the cooling for the tip is similar to that provided in respect of U.S. Pat. No. 3,455,137.

Another type of replaceable tip for a piercing mandrel is described in U.S. Pat. No. 1,374,369. The replaceable tip is threaded on the end of an adaptor connected to a piercing mandrel. The adaptor delivers to the end thereof, a cooling fluid which flows from the inside of the tip, rearwardly along inclined channels to be returned through the adaptor and along the stem for disposal. The piercing mandrel has a pointed end, so that in the area where the tube is extruded off of the end of the piercing mandrel, there is a complete lack of cooling so that the replaceable tip can loose its temper and warp in the area where the replaceable tip is threaded on the adaptor of the stem of the piercing mandrel. The adaptor is connected to the stem by a pin which results in a point of weakness particularly in view of the adapter being exposed between the tip and the stem. The adapter can warp due to excessive heating.

In die casting processes, thought has been given to cooling of the cap of the plunger for casting aluminum and the like such as is described U.S. Pat. Nos. 5,048,592 and 5,233,912. The plunger delivers cooling fluid to the end of the piston rod which flows over the face of the piston rod and within the cap of the plunger to provide a degree of cooling in the cap and thereby maintain the cap at temperatures suitable for die casting aluminum. The complex cooling system of die cast caps is more readily achieved because, very little, if any, pressure is exerted on the plunger because the metal to be die cast is in liquid form. Hence, a bayonet type connection can be used in coupling the die casting cap to the plunger.

U.S. Pat. No. 3,315,515 describes a reeler plug which is used at the piercing station of a seamless tube mill to form tubing by use of reeler rolls which form the metal over the mandrel bar into a tube. The skewed working rolls of the wheeler stand engage the work piece, where the work piece is rotated and fed forwardly over the plug 14 and on to the mandrel which itself may be rotated in the continuous formation of tube. This method of forming tubing is quite different from the extrusion of tubing. The reeler plug has to withstand the compression forces of the reeler rolls, while at the same time, effect cooling of the reeler plug. A spiral rib is used within the reeler plug to support the exterior of the plug on an inner cylindrical support of the mandrel. Cooling water as introduced to the reeler plug from the interior of the mandrel flows in a spiral manner rearwardly of the plug and returned through the mandrel. The spiral rib, in addition to acting as an effective bearing to resist crushing of the plug under extreme conditions of service, also enhances heat transfer. By virtue of the spiral rib contacting the mandrel support portion, the cooling fluid is constrained to flow through the spiral channel which induces a laminar flow of cooling fluid and as a consequence, actually reduces heat transfer.

In piercing mandrels, the accepted technology for cooling is that as described in the above noted patents, and in particular U.S. Pat. No. 3,580,037, where a very sturdy arrangement is provided and cooling is achieved by simply circulating fluid through the annular cavity between the outer shell of the piercing mandrel and the inner supply tube. Industry has generally accepted that piercing mandrels of this structure are usually acceptable for one or two shifts of tube extrusion and then must be replaced. Usually, in a single shift or a double shift, there would be 800 to 1000 shots in extruding tube material. However, in view of the cooling technique, it is generally accepted that only 10 to 50 good shots are achieved out of those 800 to 1000. After the 10 to 50 good shots, the quality of the extruded tube begins to fall off and at the end of the shift it is reasonable to expect scrap of up to 80% of the extruded material. Such scrapping of the extruded tube becomes expensive due to having to recycle and remelt the material for subsequent extrusion. Such reduction in tube quality is due to the poor cooling characteristics in the piercing mandrel tip and stem portion, resulting in the useful portion of the mandrel loosing its hardness, due to overheating and consequent warping of the mandrel.

It is therefore an object of this invention to improve the cooling in the piercing mandrel and achieve thereby significant unexpected benefits and advantages in the use of piercing mandrels to extrude tubing of higher temperature metals such as brass, copper and the like.

SUMMARY OF THE INVENTION

In accordance with an aspect of the invention there is provided a tube extrusion apparatus for extruding a tube of metal having an extrusion temperature above the annealing temperature of H13 tool steel such as brass and copper and the like. The extrusion apparatus comprises:

i) an extrusion container for a billet of such metal to be extruded;

ii) an extrusion die at an extruding end of the container iii) an extrusion ram for entering an open end of the container opposite the extrusion die;

iv) the extrusion ram having a piercing mandrel located centrally of the ram and co-axial therewith; the ram when positioned in the container providing alignment of the piercing mandrel with the die such that when the piercing mandrel is extended from the ram to pierce a billet of metal in the container, the piercing mandrel travels through the die to define an annulus through which a tube of metal at its extruding temperature is extruded;

v) the piercing mandrel having a stem portion with a leading tip, the tip having a cooling channel, cooling fluid being supplied to the cooling channel in the tip and removed therefrom by a cooling fluid supply tube in the stem portion of the mandrel;

vi) a replaceable tip for the piercing mandrel, the tip having an axially extending bore with a blind end which defines a working leading face for said tip, the tip bore having an internal female thread for threadably engaging an external male thread component of the stem portion to complete mounting of the tip on the stem;

vii) a modified shape for the bore of the tip and a complementary modified shape for the stem component to which the tip ie threaded, the stem component having a reduced portion of a length corresponding in length with the bore depth, the reduced portion having an innermost annular shoulder, a proximate male threaded portion, and a distal end, the tip having at the bore entrance an annular ledge for engaging the shoulder, an adjacent female threaded portion for engaging the male threaded portion.

The improvement being characterized in improved cooling for the tip and comprises:

viii) the distal end of the stem component reduced portion defining a stop where the blind end of the tip bore contacts the stop, the stop having a planar face and the distal end having a corresponding mating planar face for sealing engagement and transfer of thrust forces from the tip to the stem reduced portion, ix) a cooling channel system comprising a disperser provided in the mating faces of the tip blind end and the stem distal end for dispersing cooling fluid outwardly of the mating faces as such cooling fluid flows out of the stem distal end from the cooling fluid supply tube, the cooling channel system further comprising an annular channel at the perimeter of the mating faces in communication with the disperser to direct radially flowing cooling fluid annularly of the perimeter of the mating faces;

x) the cooling channel system further comprising about the perimeter of the stem reduced portion a plurality of equidistant longitudinally directed channels which are in communication with the annular channel, cooling fluid flowing from the annular channel longitudinally of the tip along the longitudinal channels;

xi) the stem reduced portion having a cooling fluid outlet device for collecting cooling fluid from the longitudinal channels and directing spent cooling fluid outwardly and along the stem.

In accordance with another aspect of the invention, a piercing mandrel has:

i) a stem with a leading tip, the tip having a cooling channel, cooling fluid being supplied to the cooling channel in the tip and removed therefrom by a cooling fluid supply tube in the stem of the mandrel;

ii) a replaceable tip for the piercing mandrel, the tip having an axially extending bore with a blind end which defines a working leading face for said tip, the tip bore having an internal female thread for threadably engaging an external male thread provided on a stem component portion to complete mounting of the tip on the stem;

iii) a modified shape for the bore of the tip and a complementary modified shape for the stem portion to which the tip is threaded, the stem portion having a reduced portion of a length corresponding in length with the bore depth, the reduced portion having an innermost annular shoulder, a proximate male threaded portion, and a distal end, the tip having at the bore entrance an annular ledge for engaging the shoulder, an adjacent female threaded portion for engaging the male threaded portion.

The improvement being characterized in improved cooling for the tip and comprises:

iv) the distal end of the stem reduced portion defining a stop where the blind end of the tip bore contacts the stop, the stop having a planar face and the distal end having a corresponding mating planar face for sealing engagement and transfer of thrust forces from the tip to the stem reduced portion, v) a cooling channel system comprising a disperser provided in the mating faces of the tip blind end and the stem distal end for dispersing cooling fluid in equidistant multi-radial directions as such cooling fluid flows out of the stem distal end from the cooling fluid supply tube, the cooling channel system further comprising an annular channel at the perimeter of the mating faces in communication with the disperser to direct radially flowing cooling fluid annularly of the perimeter of the mating faces;

vi) the cooling channel system further comprising about the perimeter of the stem reduced portion a plurality of equidistant longitudinally directed channels which are in communication with the annular channel, cooling fluid flowing from the annular channel longitudinally of the tip along the longitudinal channels;

vii) the stem reduced portion having a cooling fluid outlet device for collecting cooling fluid from the longitudinal channels and directing spent cooling fluid outwardly and along the stem.

In accordance with yet another aspect of the present invention a method for cooling a replaceable tip on a stem of a piercing mandrel, the method including the steps of:

i) directing cooling fluid along the stem to its distal end, ii) directing cooling fluid out of the stem distal end and within the tip to cool the tip, iii) returning cooling fluid from the tip along and outwardly of the stem, the improvement comprising:

iv) dispersing cooling fluid radially outwardly from the stem, annularly of the stem distal end and rearwardly in a longitudinal direction of the stem before returning cooling fluid from the tip along and outwardly of the stem.

BRIEF DESCRIPTION OF THE DRAWINGS

Various aspects of the invention are described with respect of the drawings wherein.

DETAILED DESCRIPTION OF THE PREFERRED EMBODIMENTS

Figure 1:
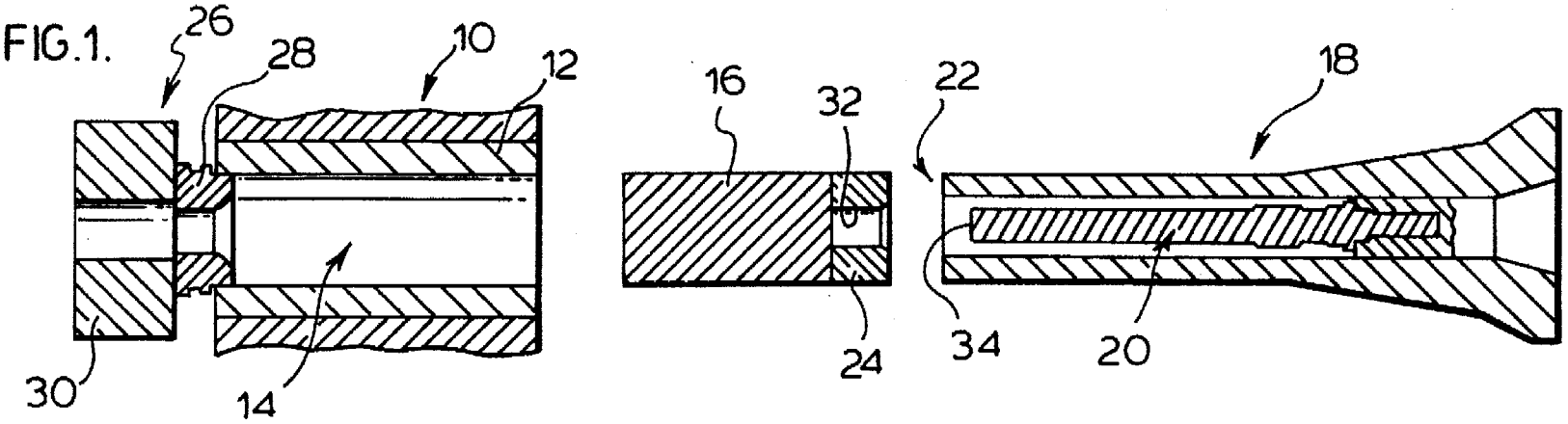
FIG. 1, is a section through a tube extruding apparatus showing the billet container, the billet and the extrusion ram having the piercing mandrel located therein.

As a general introduction to the type of apparatus in which the improvement according to this invention may be used, FIGS. 1 through 4 demonstrate the standard type of tube extrusion equipment. As shown in FIG. 1, the tube extrusion apparatus has a main body 10, with a tubular liner 12 which defines the container 14 for a billet 16. The extruding equipment also includes an extrusion ram 18 which has coaxially located therein a piercing mandrel 20. The end 22 of the ram 18 abuts a dummy block 24, which in turn abuts the billet 16. At the extruding end 26 of the apparatus, a tube extruding die 28 is provided and which has connected thereto a tube bolster 30.

Figure 2:
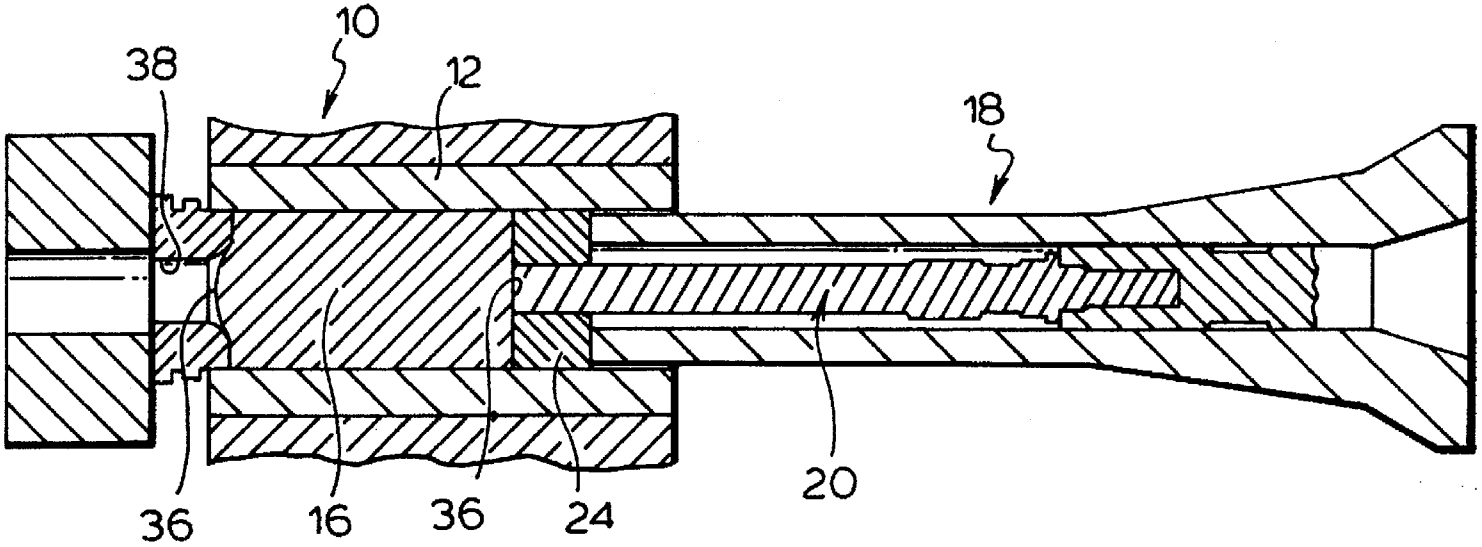
FIGS. 2, 3 and 4 are sections through the apparatus of FIG. 1 wherein the steps in extruding tube are shown.

As shown in FIG. 2, once the billet 16 is heated to its annealing temperature for purposes of tube extrusion, it is placed within the container 14 as surrounded by the liner 12. The extrusion ram 18 is advanced to contact the dummy block 24 and the piercing mandrel 20 is advanced to pass through the opening 32 of the dummy block where the distal end 34 of the piercing mandrel contacts the face 36 of the heated billet 16. Slight pressure is applied as shown in FIG. 2 by the ram 18 and by the mandrel 20 to cause the billet 16 to bulge outwardly as shown at 36 as it commences movement within the die opening 38.

Figure 3:
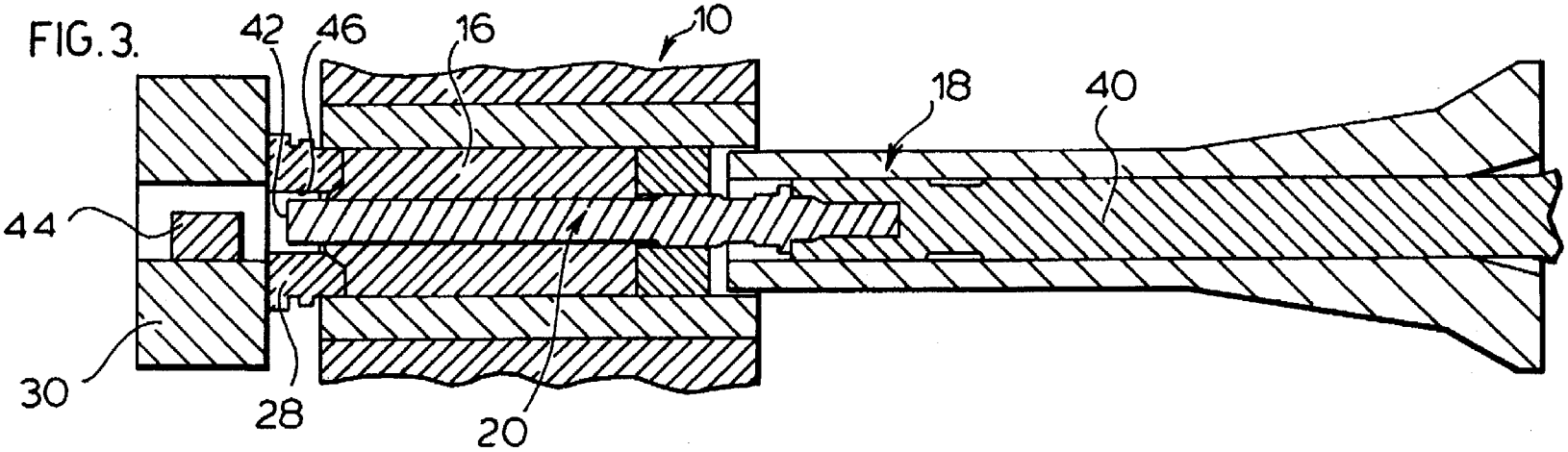

The next step in setting up the equipment to extrude tube is to advance the piercing mandrel 20 through the billet 16 by suitable plunger device 40. The piercing mandrel 20 has its distal end 42 piercing the entire billet 16 and pushing out through the die 28, a slug of waste billet material 44 which simply lies in the tube bolster 30. During the advance of the piercing mandrel 20 through the billet 16, the billet 16 is allowed to expand rearwardly which, as shown in FIG. 3 has resulted in the extrusion ram 18 being retracted.

Figure 4:
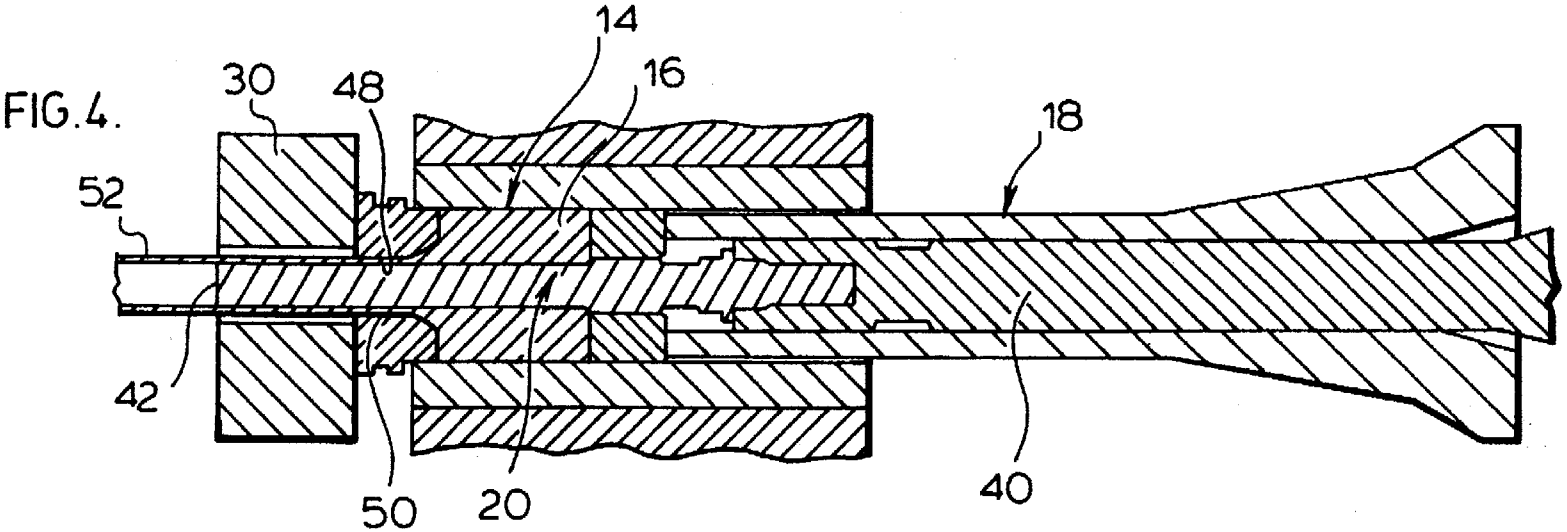

As shown in FIG. 4, the extrusion ram 18 is advanced along with the piercing mandrel 20 to extrude the billet 16 through the annulus defined between the die opening 46 and the piercing mandrel surface 48. The extrusion annulus is designated 50. The piercing mandrel distal end 42 now extends beyond the tube bolster 30. The extruded tubing 52 travels outwardly of the bolster 30 in the manner shown. As the ram 18 continues to advance, the distal end 42 of the piercing mandrel 20 extends further beyond the bolster 30. In this manner, tube 52 is formed until all of or most of the billet material is pushed out of the container 14.

As discussed with respect to the background of the invention, the piercing mandrel 20 extends a considerable distance beyond the ram 18. The piercing mandrel must have sufficient structural integrity so as to continue to be concentric with the extrusion die opening 46. Otherwise the thickness of the tube wall can vary, resulting in scrap product. As previously discussed, a common problem with piercing mandrels is that the excessive temperatures of copper, brass and the like when the mandrel is made of less expensive tool steel, results in the mandrel stem and tip loosing its hardness and hence commencing to warp. It is apparent from FIG. 4 that such warping of the piercing mandrel can cause considerable variation in the tube wall thickness, resulting in considerable scrap. In view of the considerable extension of the piercing mandrel beyond the ram 18, a slight loss in hardness in the mandrel can result in the significant warping of the mandrel end and hence resulting in tube eccentricity. It has been found however, that by cooling the tip of the piercing mandrel and preventing the tip from attaining temperatures at which the mandrel looses its hardness, the life of the piercing mandrel can be greatly extended to provide for several shifts of operation compared to the normal one or two shifts of operation. Even though the tip of the piercing mandrel extends well beyond the die of the extrusion apparatus, a loss of hardness in the tip can result in warping and thereby affect the concentricity of the tube as it extends beyond the bolster 30. similarly, it has been found that by providing improved cooling for the mandrel stem, loss of hardness in the stem portion can be minimised to extend the life of the mandrel. Effective cooling of the mandrel stem is required because during tube extrusion, after the mandrel tip has pierced the billet, and extends beyond the die, it is the stem portion of the mandrel which is within the die and hence is also subjected to high temperatures during the tube extrusion process.

Figure 5:
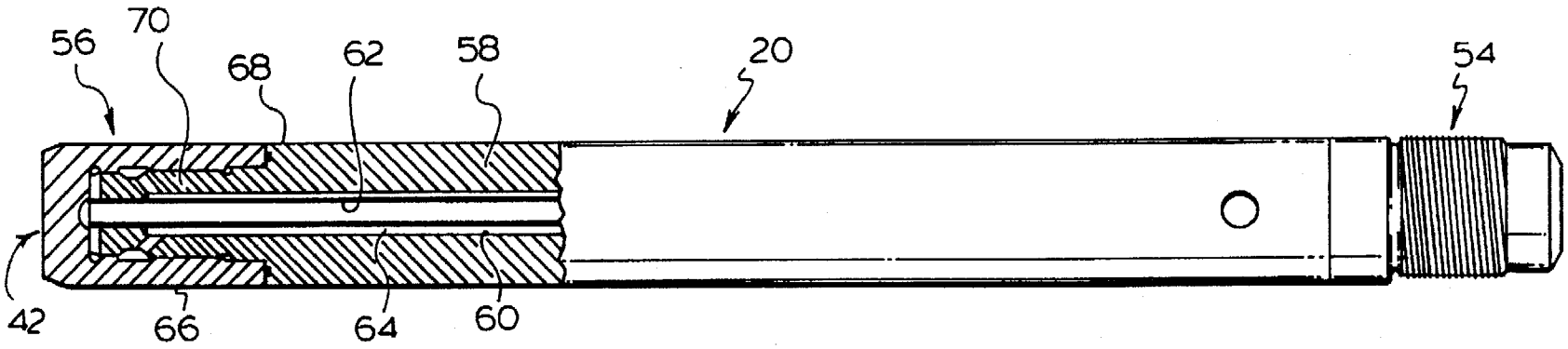
FIG. 5, is a side view of the piercing mandrel having a section thereof removed.
Figure 8:
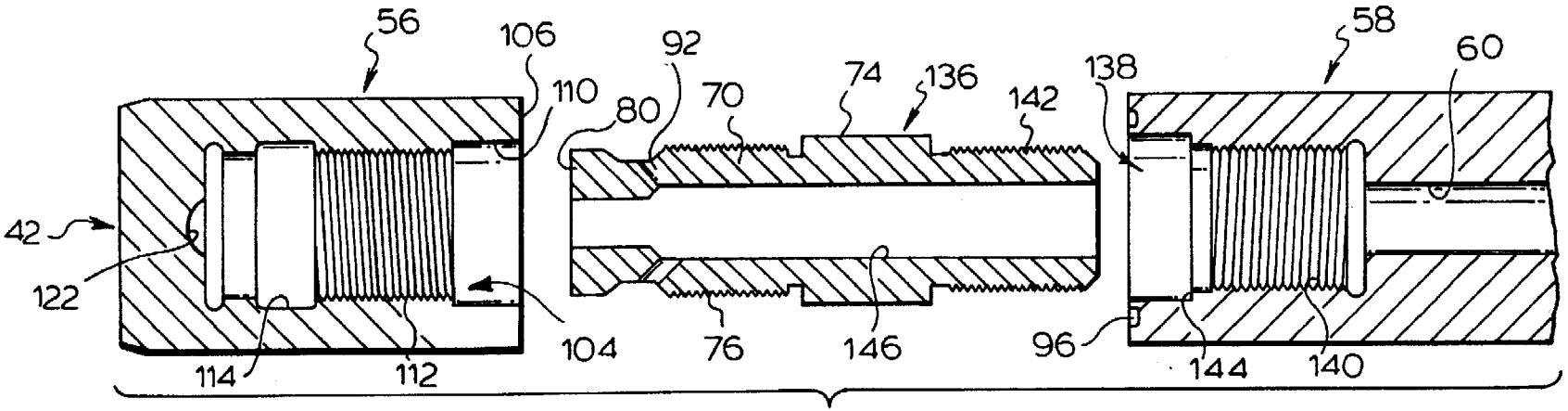
FIG. 8 is an exploded view of an adaptor used in connecting the removable tip to the stem.

Referring to FIG. 5, a preferred embodiment of the invention is shown in respect of one embodiment for improved cooling of the piercing mandrel 20. The piercing mandrel 20 has a threaded end 54, which in the normal manner is connected to the plunger 40. Such threaded connection is sufficient to support in a rigid manner, the piercing mandrel as it extends beyond the plunger 40. The distal end 42 of the piercing mandrel is provided by the removable piercing mandrel tip 56. The stem portion 58 of the piercing mandrel has a hollow interior 60 extending the length of the piercing mandrel and in which a tube 62 is provided. The tube 62 defines between the hollow portion 60 and the tube perimeter an annulus 64 which serves to carry spent cooling fluid outwardly of the mandrel 20. The tube 62 is used to supply fresh cooling fluid to the end of the stem and as will be discussed with respect to FIG. 8 provide a substantially improved cooling of a removable tip. The removable tip 56 has an exterior surface 66 which is flush with the periphery 68 of the stem. The replaceable tip 56 is threaded on to the reduced portion 70 of the stem so as to support the replaceable tip for use in tube extrusion.

Figure 6:
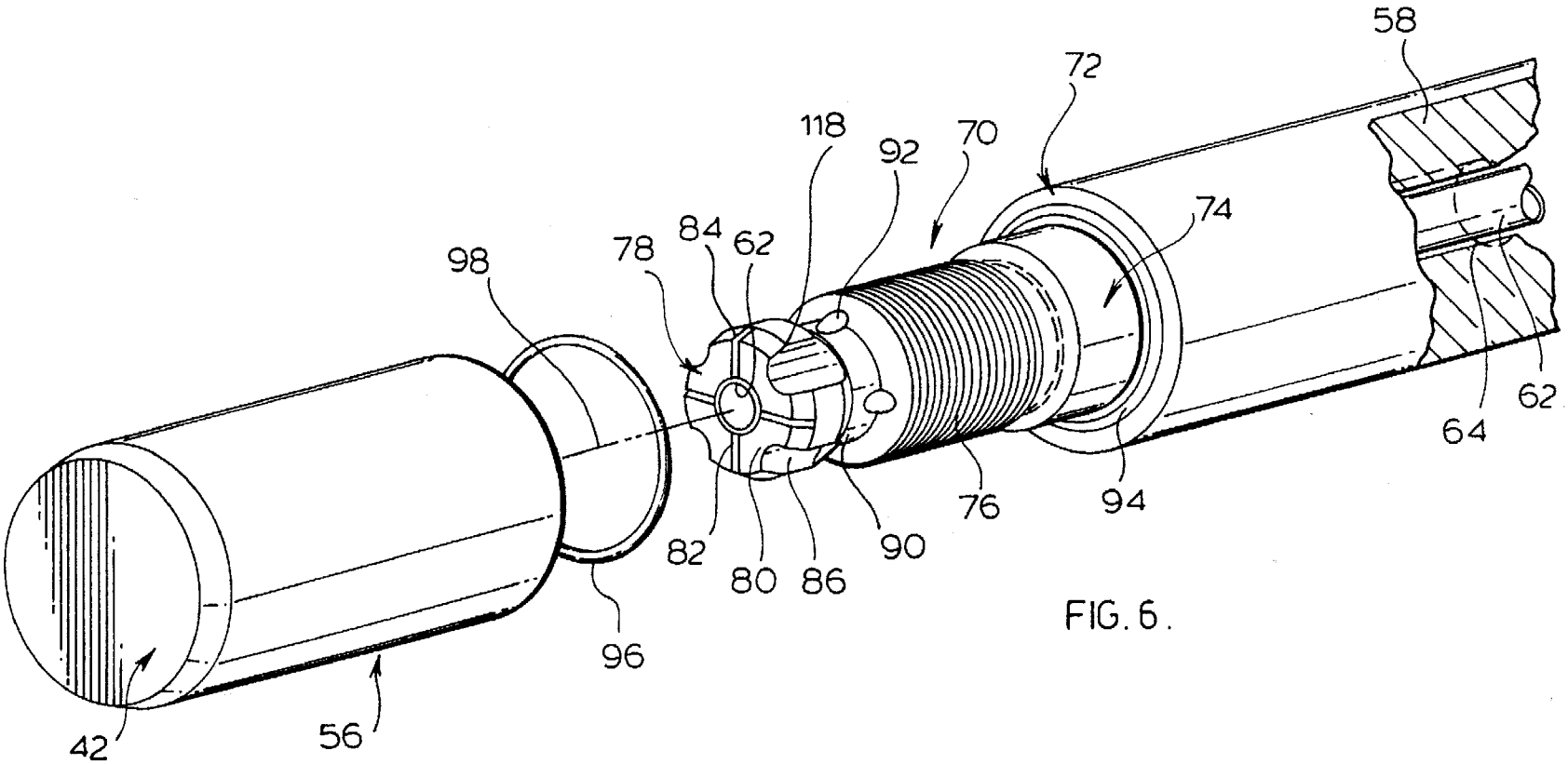
FIG. 6 is an exploded view of the replaceable tip for fitment on the reduced threaded end of the piercing mandrel stem.

The exploded view of FIG. 6 demonstrates the mounting of the replaceable tip on the stem reduced component portion 70. The reduced portion is defined in accordance with this particular embodiment by a shoulder 72 with an annular land 74. The land 74 is located between the threaded portion 76 which is proximate the shoulder 72. The stem 58 has a distal end 78 which is defined by its planer face 80. The tube 62 is set back of the planer face 80 as is shown in more detail in FIG. 7. The planer face 80 has a plurality of equi-distant channels 82 formed therein which are part of the dispersion system for dispersing cooling fluid about the interior of the tip 56. The stem distal end also has a chamfered portion 84 formed therein which defines a circumferential annular channel when the tip is mounted on the stem. This allows cooling fluid to be dispersed in a circumferential direction as will be discussed with respect to FIG. 7. The stem reduced portion also has equi-distant channels 86 extending in the direction of the longitudinal axis 88 of the stem. These channels carry cooling fluid rearwardly into the circumferential depression 90 which has holes 92 formed therein for carrying away spent cooling fluid through the annulus 64 of the stem 58.

Figure 7:
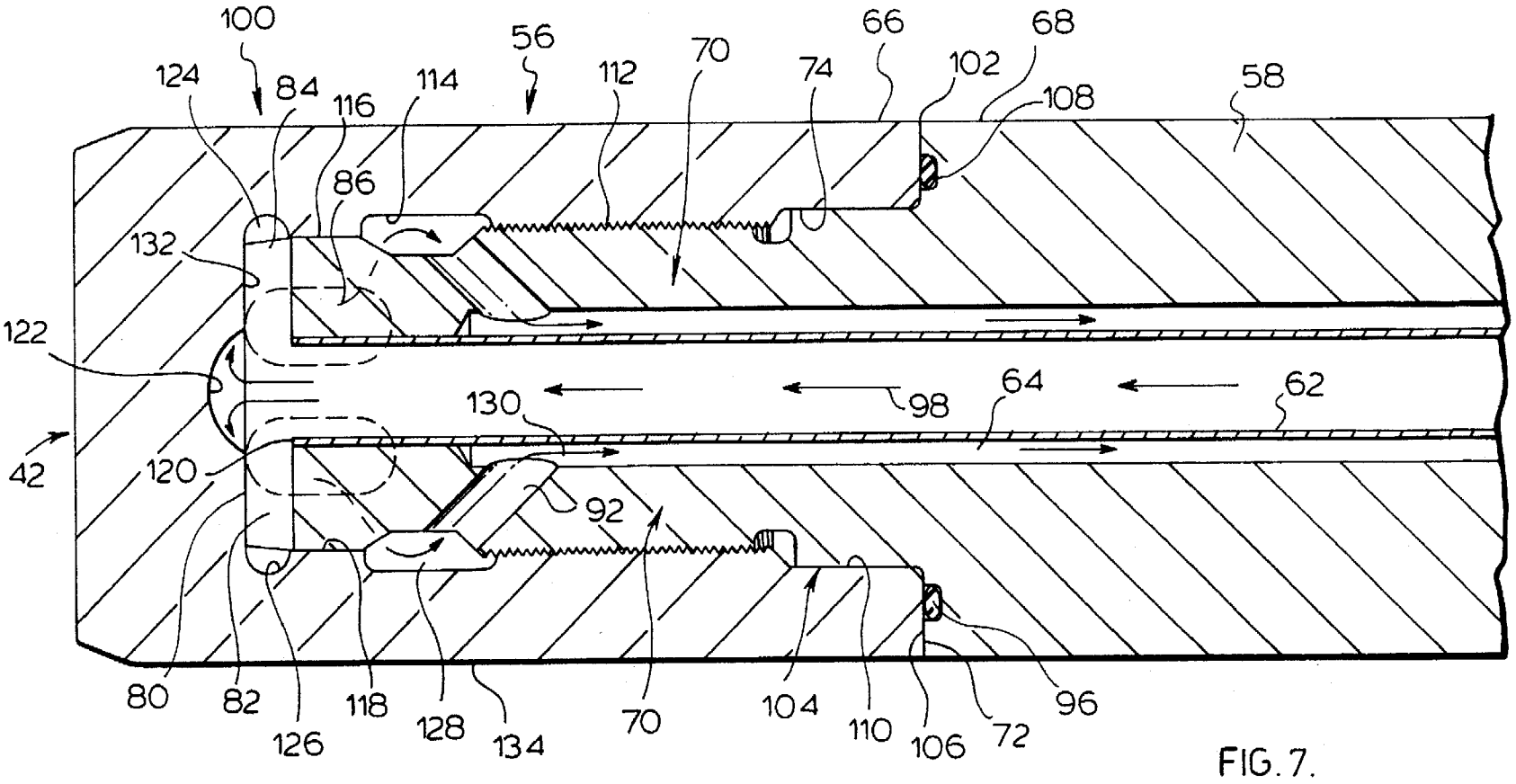
FIG. 7 is a section through the piercing mandrel stem and replaceable tip.

The shoulder 72 may have formed therein a suitable groove 94 to receive the O-ring seal 96 as the tip 56 is threaded and secured thereon in the manner we discussed with respect to FIG. 7.

The section of FIG. 7 clearly illustrates the interrelationship of the removable tip 56 to the reduced portion 70 of the stem body 58. Tube 62 delivers in the direction of arrow 98, the necessary cooling fluid to cool the distal end 42 of the removable tip 56 and the forward region 100 of the removable tip. The removable tip is designed to fit tightly with the reduced stem portion 70 so as to provide a rigid extension of the stem 58. As described with respect to FIG. 5, the outer perimeter 68 of the stem 58 is flush with the outer surface 66 of the replaceable tip. Such flush fit at the joint 102 of the tip with the stem is of course desired to ensure that there is no interruption or disconformity on the tube interior as it is extruded over the surface of the piercing mandrel.

The replaceable tip 56, has a bore generally designated 104 provided therein to couple with the reduced stem portion 70. The replaceable tip has a shoulder portion 106 which abuts the shoulder 72 of the stem. The O-ring 96 is compressed between the face of shoulder 106 and the bottom of the recess 108 of the groove 94. The 0-ring 96 seals the replaceable tip to the stem body to prevent the escape of any fluid which may pass between the land surface 74 of the reduced stem and the corresponding mating land surface 110 of the bore 104 of the replaceable tip. The bore 104 also has a threaded female portion 112 which engages the threaded male portion 76 of the stem. The bore has an annular recess 114 which is aligned with the annular depression 90 in the stem. Beyond the recess 114 is an annular face 116 for engaging the annular land portions 118 which are shown more clearly in FIG. 6. The distal end 80 of the stem has the end 120 of the tube 62 set back behind channel 82 as shown in FIG. 7. The depth of the radial extending channels 82 is shown relative to the face 80 of the distal end. The bore in the replaceable tip has a circular dimple 122 provided therein to allow cooling fluid to flow outwardly of the tube and be dispersed evenly into the radially outwardly extending channels 82, As the cooling liquid flows radially outwardly, the cooling liquid encounters the annular channel 124 which is defined between the chamfered face 84 and the annular recess 126 in the bore 104 of the replaceable tip. The rearwardly longitudinally extending channels 86 are shown relative to the annular channel 126 which provides for flow of liquid into the annular collector region 128 which returns spent cooling fluid through the holes 92 into the annular recess 64. The spent cooling fluid is then returned for disposal along with annular portion 64 in the direction of arrows 130.

This structural union of the replaceable tip with the reduced stem portion provides a very rugged structure for use as a piercing mandrel in tube extrusion. The cooling of the blind end 132 of the bore 104 insures that the distal end 42 of the tip retains its hardness and as well cooling in the annular channel 126 insures that this region 100 of the replaceable tip also remains sufficiently cool to retain the hardness thereof. The mating interfit of the faces 80 of the distal end of the stem with the blind end 132 of the replaceable tip, the inner engagement of the faces 118 of the reduced stem portion with the land portion 116 and the mating inter relationship of the circumferential land 74 and the corresponding annular face 110 ensures a rigid interconnection of the tip to the stem 58. By virtue of the cooling of the stem and region 100 and its distal end 42, warping of the region 100 is considerably reduced by retarding the time in which hardness in the tip is lost due to repeated piercing of billets. Cooling in annular collector chamber 128 also insures rearwardly of the hottest portion of the tip, that region 134 is also kept at a suitable temperature to avoid loss of hardness in this region. This ensures that the threaded engagement of the tip to the reduced stem remains secure without warping in the threaded area.

In view of the replaceable nature of the tip for the piercing mandrel, it is understood that the tip may be coated with materials which further enhance the hardness of the tip surface, thereby further extending its life. This could not be accomplished with the former integral mandrel structure. The tip may be surface hardened by use of suitable hardening agents such as titanium, boron, carbide and the like. The surface may also be coated with high temperature steels such as the previously mentioned Inconel. This greatly facilitates repair and replacement of the piercing mandrels. Assuming the operation does not result in damage to the stem, the stem need never be replaced. Instead the tips can be readily replaced from time to time as needed. By coating the replaceable tip, an indication of wear is provided so that the operator can determine when the tip requires replacement. By enhanced cooling of the replaceable tip, there is a significant increase in the life expectancy of the piercing mandrel by orders of magnitude of 5 to 10 or more. The rate at which the cooling fluid is supplied to the tip may be varied depending upon the material to be extruded into a tube. The configuration of the dispersion device at the stem distal end enhances the radial flow of the cooling fluid to ensure that the tip end is kept at the proper temperature during the piercing process and avoiding loss of hardness.

By use of the replaceable tip having the improved cooling system, the tip may be made out of standard tool steel such as H13 tool steel and thereby considerably reduce the cost of the tip while at the same time providing an unexpected significant increase in piercing mandrel life, It is also appreciated that a suitable temperature sensing device may be included in the mandrel tip which provides a read out of the mandrel temperature. This will allow either by manual or automated process control to increase or reduce the flow rate of cooling fluid into an out of the tip, to thereby ensure that the tip is in the proper operating temperature range so as to provide a consistent quality extruded tube product but not appreciably affect the mandrel hardness. By reducing the chance of the mandrel tip warping, previously due to overheating during the cooling process, accuracy and alignment of the tip of the piercing mandrel with the die is assured.

The alternative embodiment for connecting the removable tip 52 from the stem 58 is shown in FIG. 8. An adaptor 136 is used to connect the tip 56 to the stem 58. The adaptor has the usual forward portion of the threaded stem of FIGS. 6 and 7 and has the reduced portion 70 with the male threaded portion 76 and annular land portion 74. The cooling return channels 92 are shown. The tip 56 is threaded on to the adaptor 136. The tip 56 has a bore 104 with the shoulder 106 and the land surface 110. A female threaded portion 112 is provided in the bore for threaded engagement with the male thread 76. A recess 114 is provided which in conjunction with channels 92, provide the annulus coolant return space 128 of FIG. 9. For enhancing the disbursement of coolant across the face of the distal end 80 of the adaptor, the dimple 122 is provided. The adapter 136 is threaded into the stem 58, where the stem has a bore 138 formed therein with a female threaded portion 140 to receive the threaded male portion 142. The bore 138 includes a shoulder 144 and a groove 96 as per the stem embodiment of FIG. 7 to receive a ring seal. The adaptor 136 has an enlarged central bore 146 which is the same internal diameter as the bore 60 in the stem 58. The adaptor 136 is assembled with the stem 58 in the manner shown in FIG. 9. The adaptor 136 is threaded into the stem 58 to provide tight inter-engagement at face 144. The tip 56 is then threaded onto the adaptor 136 in the same manner as described with respect to FIG. 7 where ring seal at 96 seals the joint at 102. The bore 60 in the stem 58 and the bore 146 in the adaptor are aligned where the adaptor meets the stem at juncture 148. The adaptor has a reduced bore 150 which receives the copper tube 62. As previously described, the copper tube is inserted in the bore 150 such that its end terminates at the channels 82. The use of the adaptor 136 provides many significant advantages. For example, the adaptor allows one to form the bore 60 in the stem 58 from the outer end thereof. This ensure concentricity of the bore 60 with the exterior 152 of the stem 58 in the region that is located in the dye during tube extrusion. The concentricity of the bore 60 with the exterior surface 152 ensures uniform cooling of the outer surface 152 to minimize the loss in hardness in the stem during the tube extrusion process, The adaptor 136 may be made of material different from the stem and the tip. For example, the adaptor 136 since it is a smaller component and is necessary to maintain dimensional stability, may be made out of stainless steel. It is far easier to machine the adaptor 136 in providing the reduced bore 150 therein to receive the copper tube 62 so that machining is simplified and the accuracy of the bore 60 in the stem is greatly improved to enhance cooling.

Figure 9:
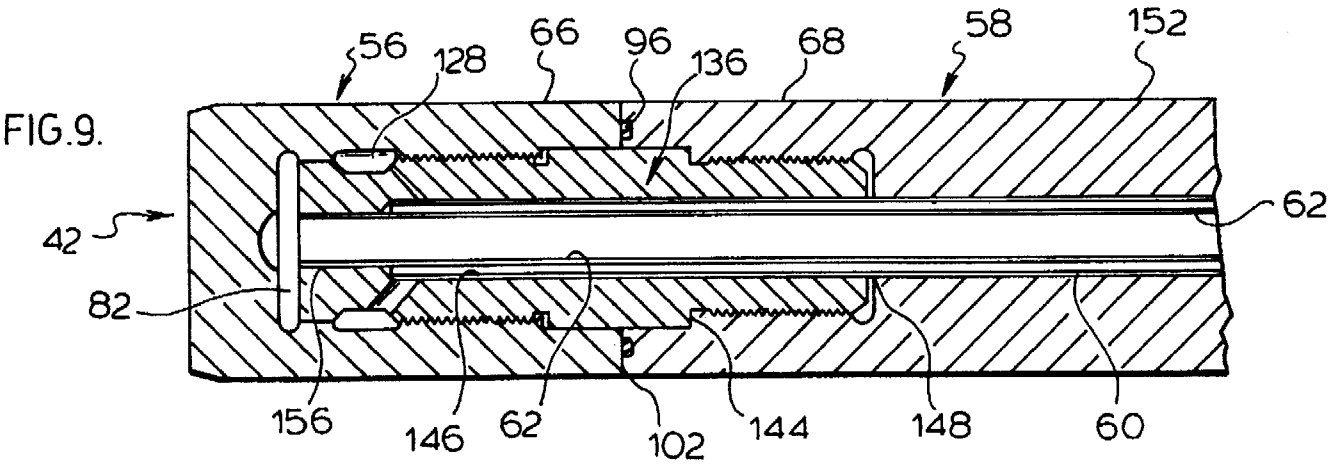
FIG. 9 shows the assembly of FIG. 8.
Figure 10:
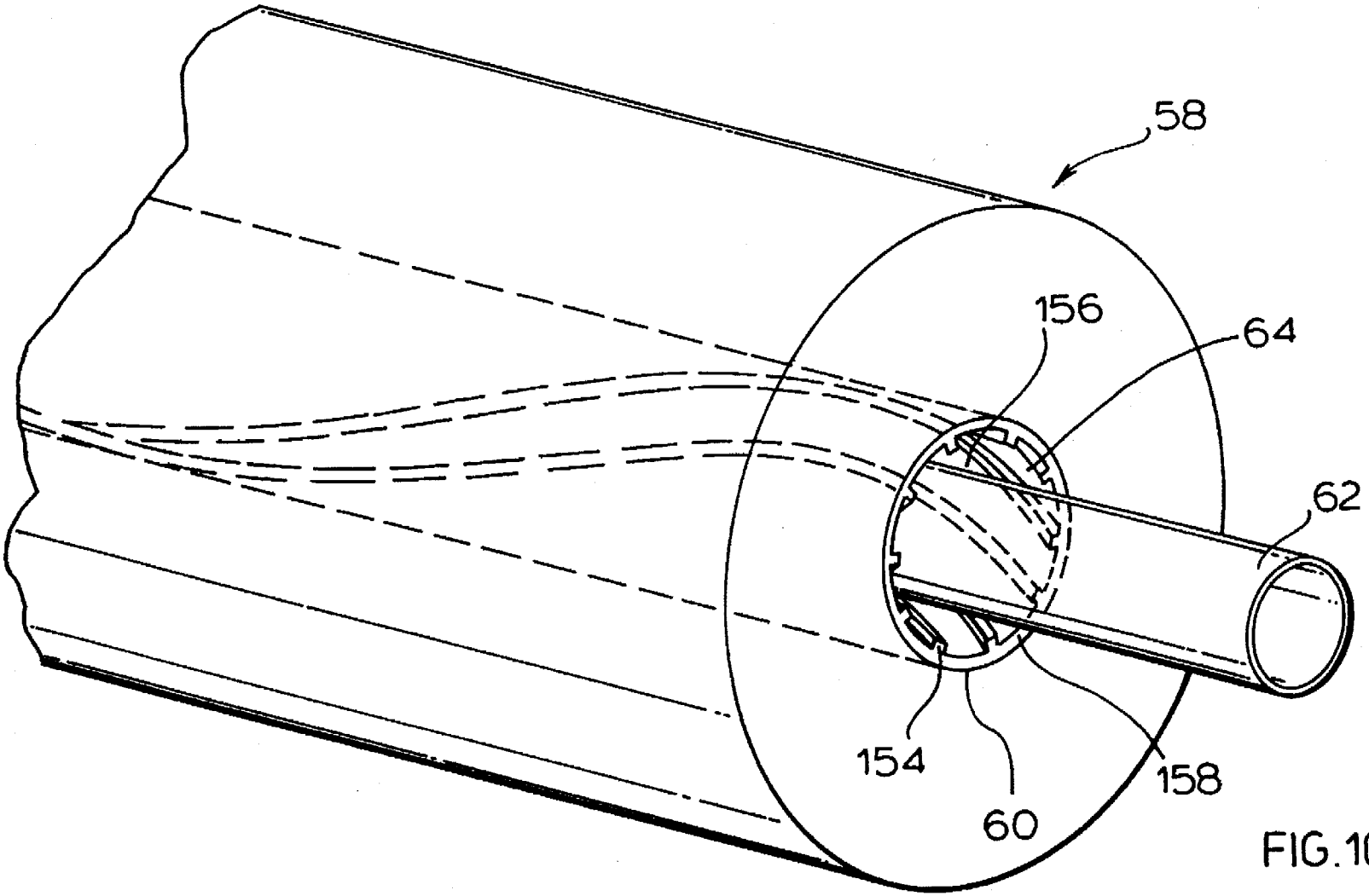
FIG. 10 is a perspective view of the stem with provision of improved cooling.

Cooling may also be improved in the stem 58 by ensuring that the inner copper tube 62 is concentric with the bore 60 of the stem. It is important for the concentric relationship of the tube 62 relative to the bore 60, to provide equal volumes of coolant flowing in the return direction through the annulus 64 between the exterior of the tube 62 and the interior of the bore 60. Applicant has found however that cooling of the stem 58 may be greatly enhanced by providing on the interior surface of the bore 60, ridges 154 as shown in FIG. 10. The ridges cause the coolant to return through annulus 64 in a spiral manner and in addition to induce turbulence in the flow of that coolant to increase thereby the heat transfer to the coolant. Laminar flow tends to develop in the annulus 64 with the smooth surface of the interior of the bore 60. By using the ridges 154, the flow is disrupted and becomes some what more turbulent to enhance heat transfer to the returning coolant. This ensures that the stem 58 is properly cooled to withstand the tube extrusion temperature with the stem portion extending through the dye during tube extrusion. Since it would be difficult to machine the fins 154 on the interior of the bore 60, the fins 154 are provided on the interior 156 of a tube 158. The tube 158 is pressed, fitted within the bore 60 to provide a tight fit of the tube 158 in the bore to ensure efficient heat transfer from the stem 58 through to the coolant within the annulus 64. The tube 158 may be of copper or the like which may be cooled, inserted within the bore and allowed to expand to snugly contact the interior of the bore 60. The fine 154 extend inwardly into the annulus 64. The fins may be spaced from the exterior of the copper tube 62, thereby generating maximum turbulence or may be in contact with the exterior of the tube 62 to enhance the spiral flow of the returning coolant. The tube 158 may extend the length of the mandrel stem and terminate at juncture 148 as shown in FIG. 9.

Testing of the stem 58 in respect of loss of hardness during tube extrusion has determined that the stem having a rock ball hardness of about 47 can become greatly softened during the extrusion process, particularly in the region behind the replaceable tip to a hardness of less than 15. At this hardness, the stem begins to warp and results in unacceptable extruded product. By the enhanced cooling provided by the embodiment of FIG. 10, the hardness in the stem is retained to avoid stem warping and thereby maintain acceptable tube product during extended tube extrusion processes.

Although the preferred embodiments of the invention are described herein in detail, it will be understood by those skilled in the art that variations may be made thereto without departing from the spirit of the invention or the scope of the appended claims.

The embodiments of the invention in which an exclusive property or privilege is claimed are defined as follows:

1. In a tube extrusion apparatus for extruding a tube of metal having an extrusion temperature above the annealing temperature of H13 tool steel, such as brass and copper and the like, said extrusion apparatus comprising:

i) an extrusion container for a billet of such metal to be extruded;

ii) an extrusion die at an extruding end of said container iii) an extrusion ram for entering an open end of said container opposite said extrusion die;

iv) said extrusion ram having a piercing mandrel located centrally of said ram and co-axial therewith; said ram when positioned in said container providing alignment of said piercing mandrel with said die such that when said piercing mandrel is extended from said ram to pierce a billet of metal in said container, said piercing mandrel travels through said die to define an annulus through which a tube of metal at its extruding temperature is extruded;

v) said piercing mandrel having a stem portion with a leading tip, said tip having a cooling channel, cooling fluid being supplied to said cooling channel in said tip and removed therefrom by a cooling fluid supply tube in said stem portion of said mandrel;

vi) a replaceable tip for said piercing mandrel, said tip having an axially extending bore with a blind end which defines a working leading face for said tip, said tip bore having an internal female thread for threadably engaging an external male threaded component of said stem portion to complete mounting of said tip on said stem;

vii) a modified shape for said bore of said tip and a complementary modified shape for said stem component to which said tip is threaded, said stem component having a reduced portion of a length corresponding in length with said bore depth, said reduced portion having an innermost annular shoulder, a proximate male threaded portion, and a distal end, said tip having at said bore entrance an annular ledge for engaging said shoulder, an adjacent female threaded portion for engaging said male threaded portion, the improvement being characterized in improved cooling for said tip and comprises:

viii) said distal end of said stem component reduced portion defining a stop where said blind end of said tip bore contacts said stop, said stop having a planar face and said distal end having a corresponding mating planar face for sealing engagement and transfer of thrust forces from said tip to said stem reduced portion;

ix) a cooling channel system comprising a disperser provided in said mating faces of said tip blind end and said stem distal end for dispersing cooling fluid outwardly of said mating faces as such cooling fluid flows out of said stem distal end from said cooling fluid supply tube, said cooling channel system further comprising an annular channel at the perimeter of said mating faces in communication with said disperser to direct radially flowing cooling fluid annularly of the perimeter of said mating faces;

x) said cooling channel system further comprising about the perimeter of said stem reduced portion a plurality of equidistant longitudinally directed channels which are in communication with said annular channel, cooling fluid flowing from said annular channel longitudinally of said tip along said longitudinal channels;

xi) said stem component reduced portion having a cooling fluid outlet device for collecting cooling fluid from said longitudinal channels and directing spent cooling fluid outwardly and along said stem.

2. In a tube extrusion apparatus of claim 1, said stem component reduced portion having land portions between said longitudinally directed channels, said lands engaging interior surfaces of said tip bore to support peripherally said tip.

3. In a tube extrusion apparatus of claim 1, said disperser having a plurality of equidistant radially directed channels provided in said stem distal end.

4. In a tube extrusion apparatus of claim 1, said stem reduced portion having an annular land between said male threaded portion and said stem innermost annular shoulder, said annular land of said stem engaging a corresponding annulus interior surface of said tip bore to locate said tip annular ledge on said stem innermost annular shoulder.

5. In a tube extrusion apparatus of claim 1, said stem component reduced portion being an adapter which has a male threaded rear part, said stem having a female threaded bore where said innermost annular shoulder is provided by stem perimeter about said threaded female bore, said adapter is threaded into said stem where said cooling fluid supply tube extends through said adapter.

6. In a tube extrusion apparatus of claim 1, said cooling fluid supply tube and said cooling fluid outlet device comprising a bore extending through said stem and terminating proximate said stem distal end, said cooling fluid supply tube extending concentric with said bore and extending through said stem distal end said cooking fluid outlet device being in communication with an annulus defined between said cooling fluid supply tube and said bore to carry cooling fluid away from said tip, said bore having means on its interior surface to induce turbulence in cooling fluid flow along said annulus and enhance thereby conduction of heat from said stem portion.

7. In a tube extrusion apparatus of claim 6, said means for inducing turbulence comprising a tube fitted in said bore, said tube having projecting fins.

8. In a tube extrusion apparatus of claim 7, said tube projecting fins being spiral shaped.

9. In a piercing mandrel having:

i) a stem with a leading tip, said tip having a cooling channel, cooling fluid being supplied to said cooling channel in said tip and removed therefrom by a cooling fluid supply tube in said stem portion of said mandrel;

ii) a replaceable tip for said piercing mandrel, said tip having an axially extending bore with a blind end which defines a working leading face for said tip, said tip bore having an internal female thread for threadably engaging an external male thread provided on a stem component portion to complete mounting of said tip on said stem;

iii) a modified shape for said bore of said tip and a complementary modified shape for said stem portion to which said tip is threaded, said stem portion having a reduced portion of a length corresponding in length with said bore depth, said reduced portion having an innermost annular shoulder, a proximate male threaded portion, and a distal end, said tip having at said bore entrance an annular ledge for engaging said shoulder, an adjacent female threaded portion for engaging said male threaded portion;

the improvement being characterized in improved cooling for said tip and comprises:

iv) said distal end of said stem reduced portion defining a stop where said blind end of said tip bore contacts said stop, said stop having a planar face and said distal end having a corresponding mating planar face for sealing engagement and transfer of thrust forces from said tip to said stem reduced portion, v) a cooling channel system comprising a disperser provided in said mating faces of said tip blind end and said stem distal end for dispersing cooling fluid in equidistant multi-radial directions as such cooling fluid flows out of said stem distal end from said cooling fluid supply tube, said cooling channel system further comprising an annular channel at the perimeter of said mating faces in communication with said disperser to direct radially flowing cooling fluid annularly of the perimeter of said mating faces;

vi) said cooling channel system further comprising about the perimeter of said stem reduced portion a plurality of equidistant longitudinally directed channels which are in communication with said annular channel, cooling fluid flowing from said annular channel longitudinally of said tip along said longitudinal channels;

vii) said stem reduced portion having a cooling fluid outlet device for collecting cooling fluid from said longitudinal channels and directing spent cooling fluid outwardly and along said stem.

10. In a piercing mandrel of claim 9, said stem reduced portion having land portions between said longitudinally directed channels, said lands engaging interior surfaces of said tip bore to support peripherally said tip.

11. In a piercing mandrel of claim 9, said disperser having a plurality of equidistant radially directed channels provided in said stem distal end.

12. In a piercing mandrel of claim 9, said stem reduced portion having an annular land between said male threaded portion and said stem innermost annular shoulder, said annular land of said stem engaging a corresponding annulus interior surface of said tip bore to locate said tip annular ledge on said stem innermost annular shoulder.

13. In a piercing mandrel of claim 9, said stem component reduced portion being an adapter which has a male threaded rear part, said stem having a female threaded bore where said innermost annular shoulder is provided by stem perimeter about said threaded female bore, said adapter is threaded into said stem where said cooling fluid supply tube extends through said adapter.

14. In a piercing mandrel of claim 9, said cooling fluid supply tube and said cooling fluid outlet device comprising a bore extending through said stem and terminating proximate said stem distal end, said cooling fluid supply tube extending concentric with said bore and extending through said stem distal end said cooking fluid outlet device being in communication with an annulus defined between said cooling fluid supply tube and said bore to carry cooling fluid away from said tip, said bore having means on its interior surface to induce turbulence in cooling fluid flow along said annulus and enhance thereby conduction of heat from said stem portion.

15. In a piercing mandrel of claim 14, said means for inducing turbulence comprising a tube fitted in said bore, said tube having projecting fins.

16. In a piercing mandrel of claim 15, said tube projecting fins being spiral shaped.

17. In a piercing mandrel of claim 9, said stem having a bore extending therethrough to said tip with a cooling fluid supply extending along said bore and concentric therewith, said cooling fluid supply tube being in fluid communication with said cooling channel, said cooling channel returning cooling fluid from said tip to an annulus defined between said cooling fluid supply tube and said bore to carry cooling fluid away from said tip, the improvement further comprising:

said bore having means on its interior to induce turbulence in cooling fluid flow along said annulus and enhance thereby conduction of heat from said stem portion.

18. In a piercing mandrel of claim 17, said means for inducing turbulence comprising a tube fitted in said bore, said tube having projecting fins.

19. In a piercing mandrel of claim 18, said tube projecting fins being spiral shaped.

20. In a piercing mandrel of claim 19, said tube being of copper.

21. In a method for cooling a replaceable tip on a stem of a piercing mandrel, the method including the steps of:

i) directing cooling fluid along said stem to its distal end, ii) directing cooling fluid out of said stem distal end and within said tip to cool said tip, iii) returning cooling fluid from said tip along and outwardly of said stem, the improvement comprising:

iv) dispersing cooling fluid radially outwardly of a planar stem distal end which abuts a mating interior planar face of said tip through a cooling channel system between said abutting stem end and tip interior, said channel system including equidistant multi-radial channels in communication at the periphery of the mating faces with an annular channel to direct the radially flowing cooling fluid annularly of the perimeter of the mating faces, v) directing the annularly flowing cooling fluid rearwardly of the stem end by a plurality of equidistant longitudinally directed channels in the stem end which are in communication with the annular channel.

22. In a method of claim 21, dispersing said cooling fluid radially outwardly in a plurality of equidistant radially directed channels in said stem adjacent said tip.

* * * * *